US008651117B2

(12) United States Patent
Gueret

(10) Patent No.: US 8,651,117 B2
(45) Date of Patent: Feb. 18, 2014

(54) APPLICATOR FOR APPLYING COSMETIC COMPOSITION TO THE EYELASHES OR EYEBROWS

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 182 days.

(21) Appl. No.: 12/727,761

(22) Filed: Mar. 19, 2010

(65) Prior Publication Data

US 2011/0083693 A1 Apr. 14, 2011

Related U.S. Application Data

(60) Provisional application No. 61/170,247, filed on Apr. 17, 2009.

(30) Foreign Application Priority Data

Mar. 20, 2009 (FR) ..... 09 51798

(51) Int. Cl.
*A45D 40/26* (2006.01)
*A45D 24/00* (2006.01)
*A46B 11/00* (2006.01)

(52) U.S. Cl.
USPC ..... 132/218; 132/320; 132/200; 401/129

(58) Field of Classification Search
USPC ..... 132/218, 200, 216, 217, 313, 317, 318, 132/320; 15/22.1, 104.2, 167.1, 114, 206, 15/207, 207.2, 160; 401/126, 121, 182, 401/176, 9, 11, 125, 129, 130, 127, 268, 401/122, 269
See application file for complete search history.

(56) References Cited

U.S. PATENT DOCUMENTS 4,241,743 A 12/1980 Schnabel et al.
4,291,432 A 9/1981 Cogswell
5,161,555 A * 11/1992 Cansler et al. ..... 132/218
(Continued)

FOREIGN PATENT DOCUMENTS

EP 0 611 170 A1 8/1994
EP 1 020 136 A2 7/2000
(Continued)

OTHER PUBLICATIONS

European Office Action related to European Patent Application No. EP 10 15 6415, dated Feb. 21, 2011.
(Continued)

*Primary Examiner* — Vanitha Elgart
(74) *Attorney, Agent, or Firm* — Oliff PLC

(57) ABSTRACT

An applicator used to apply a cosmetic composition to the eyelashes or the eyebrows includes a stem having a distal stem portion extending along a longitudinal axis and further includes a brush extending from the distal stem portion. The brush includes a core supporting bristles. The core extends along a longitudinal axis that is entirely contained within a plane. The core further has a first curve that is concave towards a first side of the core and a second curve, different from the first curve, that is concave towards a second side of the core opposite from the first side of the core. The longitudinal axis of the core crosses the longitudinal axis of the distal stem portion at least once. The core of the brush extends along the longitudinal axis of the core towards a free end of the core without turning back towards the distal stem portion.

22 Claims, 4 Drawing Sheets

(56) References Cited

U.S. PATENT DOCUMENTS

| | | | | |
|---|---|---|---|---|
| 5,542,439 | A * | 8/1996 | Gueret | 132/218 |
| 5,551,456 | A * | 9/1996 | Hartel | 132/218 |
| 5,937,870 | A * | 8/1999 | Gueret | 132/218 |
| 6,003,519 | A | 12/1999 | Gueret | |
| 6,067,997 | A * | 5/2000 | Gueret | 132/218 |
| 6,237,609 | B1 * | 5/2001 | Vasas | 132/218 |
| 6,343,607 | B1 * | 2/2002 | Gueret | 132/218 |
| 6,345,923 | B2 | 2/2002 | Gueret | |
| 6,494,215 | B2 * | 12/2002 | Gueret | 132/218 |
| 6,508,603 | B1 | 1/2003 | Vasas | |
| 6,532,967 | B1 | 3/2003 | Dumier | |
| 6,662,810 | B2 | 12/2003 | Gueret | |
| RE38,397 | E * | 1/2004 | Gueret | 132/218 |
| 7,069,936 | B2 * | 7/2006 | Gueret | 132/218 |
| 7,089,946 | B2 * | 8/2006 | Rousselet | 132/218 |
| 8,082,928 | B2 * | 12/2011 | Gueret | 132/218 |
| 8,091,561 | B2 * | 1/2012 | Gueret | 132/218 |
| 2002/0020426 | A1 | 2/2002 | Gueret | |
| 2002/0139385 | A1 * | 10/2002 | Gueret | 132/218 |
| 2003/0084913 | A1 * | 5/2003 | Gueret | 132/218 |
| 2005/0236008 | A9 * | 10/2005 | Gueret | 132/218 |
| 2007/0221241 | A1 * | 9/2007 | Gueret | 132/218 |
| 2008/0107470 | A1 | 5/2008 | Gueret | |
| 2008/0184512 | A1 | 8/2008 | Gueret | |
| 2009/0071501 | A1 | 3/2009 | Gueret | |
| 2009/0133707 | A1 * | 5/2009 | Gueret | 132/200 |
| 2009/0320872 | A1 * | 12/2009 | Vandromme | 132/218 |
| 2010/0003065 | A1 * | 1/2010 | Haan | 401/124 |
| 2011/0030718 | A1 * | 2/2011 | Gueret | 132/218 |

FOREIGN PATENT DOCUMENTS

| | | |
|---|---|---|
| EP | 1 236 421 A1 | 9/2003 |
| EP | 1 917 883 A2 | 5/2008 |
| EP | 1 938 709 A1 | 7/2008 |
| FR | 2 882 506 A1 | 9/2006 |
| JP | 2004-16328 | 1/2004 |
| JP | 2005-87635 | 4/2005 |

OTHER PUBLICATIONS

French Search Report for FR 0951798, dated Jan. 15, 2010.
English language abstract of JP 2005-87635, Apr. 7, 2005.
Chinese Office Action related to Chinese Patent Application No. CN 201010138251.5, dated Aug. 9, 2011.
English language abstract of JP 2004-16328, Jan. 22, 2004.

* cited by examiner

APPLICATOR FOR APPLYING COSMETIC COMPOSITION TO THE EYELASHES OR EYEBROWS

This application claims benefit of U.S. Provisional Application No. 61/170,247, filed Apr. 17, 2009. This application also claims benefit of priority under 35 U.S.C. §119 to French Patent Application No. 0951798, filed Mar. 20, 2009.

FIELD OF THE INVENTION

The present invention relates to applicators for applying a cosmetic composition, such as makeup or a care product composition, e.g. mascara, to the eyelashes or the eyebrows, and to packaging and/or applicator devices including such applicators.

The invention relates more particularly to an applicator comprising a stem having a distal stem portion extending along a longitudinal axis, and a brush that extends from the distal portion of the stem, the brush comprising a core and bristles that extend from the core.

BACKGROUND OF THE INVENTION

Numerous applicators are known in which the brush comprises a core that is formed of two branches of a wire that are twisted together, trapping bristles therebetween.

Application EP 1 938 709 discloses a device including a twisted-core brush that defines an envelope surface having a cross-section of shape that is flat along a mid-plane and defining at least one face that is parallel to the longitudinal axis of the core.

Application EP 1 236 421 describes a brush that curves around at least two axes that are not parallel to each other.

Application JP 2005-087635 relates to a mascara applicator including a twisted core that curves in the shape of an arc so as to match the shape of a set of eyelashes, the twisted core carrying a flocked applicator at its free end.

In U.S. Pat. No. 6,508,603, the brush includes three successive rectilinear portions, the first in alignment with the stem, the second sloping, and the third parallel to the first.

In U.S. Pat. No. 4,241,743, the brush curves around an axis of curvature.

In application EP 1 020 136, the shape of the brush corresponds to a run of circular arcs of the same radius of curvature.

U.S. Pat. No. 6,003,519 relates to a brush for treating a lock of hair.

There exists a need to improve certain applicators, such as applicators that include brushes.

BRIEF SUMMARY

In the following description, certain aspects and embodiments of the present invention will become evident. It should be understood that the invention, in its broadest sense, could be practiced without having one or more features of these aspects and embodiments. In other words, these aspects and embodiments are merely exemplary.

Exemplary embodiments of the invention provide an applicator for applying a cosmetic composition to the eyelashes or the eyebrows. The applicator may comprise a stem having a distal stem portion extending along a longitudinal axis. The applicator also may comprise a brush extending from the distal stem portion. The brush may comprise a core supporting bristles. The core may extend along a longitudinal axis that is entirely contained within a plane. The core may further have a first curve that is concave towards a first side of the core and a second curve that is concave towards a second side of the core opposite from the first side of the core. The first curve may be different from the second curve. The longitudinal axis of the core may cross the longitudinal axis of the distal stem portion at least once. The core of the brush may extend along the longitudinal axis of the core towards a free end of the core without turning back towards the distal stem portion of the stem. The first curve may comprise a first vertex on the longitudinal axis of the core and the second curve may comprise a second vertex on the longitudinal axis of the core. The first vertex may be located on a first side of the longitudinal axis of the distal stem portion and the second vertex may be located on a second side of the longitudinal axis of the distal stem portion that is opposite from the first, side of the longitudinal axis of the distal stem portion.

The curves of the core may make it possible to obtain wiping that is not constant along the brush. In at least some embodiments, this may make it possible to obtain zones of the brush that are more loaded with composition after wiping, e.g., in troughs of the curves of the longitudinal axis of the core.

In addition to the non-constant wiping, at least some embodiments may make it possible to obtain wiping that is more uniform on faces that are parallel to the plane containing the longitudinal axis of the core.

For a brush of cross-section that is triangular for example, a constant wiping surface may be defined by an edge of the triangle. The edge may be parallel to the plane in which the longitudinal axis of the core extends.

The applicator according to at least some exemplary embodiments of the invention may make it easy to access the eyelashes at the corners of the eye for example, while favoring uniform finishing of the makeup on a set of eyelashes when the brush is turned through one fourth of a turn about the longitudinal axis of the distal stem portion, using the wiped faces more uniformly.

The phrase "without turning back towards the distal stem portion" should be understood to mean that, as the core of the brush extends from the distal stem portion toward the free end of the core, the distance traveled from the stem when projected onto the longitudinal axis of the stem always increases. In contrast, FIGS. 2 and 3 of U.S. Pat. No. 6,532,967, which corresponds to the application EP 1 020 136, show arrangements in which a core of a brush does turn back towards a distal stem portion.

The term "longitudinal axis of the distal stem portion" should be understood to mean the longitudinal axis of a rectilinear distal portion of the stem.

The tangent to the longitudinal axis of the core at any point of intersection with the longitudinal axis of the distal stem portion may form an angle with the longitudinal axis of the distal stem portion that is not zero, in particular greater than 5°, or even greater than 10° or 20°.

The tangent to the longitudinal axis of the core at any point along the core may form an angle with the longitudinal axis of the distal stem portion that may be less than 90°, or even strictly less than 90°, e.g., less than 80°, or even less than 60°.

Each of the first and second curves may comprise a vertex on the longitudinal axis of the core, the vertex of the first curve being located on a first side of the longitudinal axis of the distal stem portion and the vertex of the second curve being located on a second side of the longitudinal axis of the distal stem portion opposite from the first side of the longitudinal axis of the distal stem portion. In some examples, neither of the two vertices need to be situated on the longitudinal axis of the distal stem portion. For some examples, the longitudinal axis of the core does not need to be tangential to the longitudinal axis of the distal stem portion at each of the two vertices of the first and second curves.

The first and second curves may differ in at least one of the following characteristics: type of the curve, e.g. circular or elliptical; radius of curvature, in particular the radius of curvature at the vertex of the curve.

The first curve may extend around a first axis of curvature with a first radius of curvature and the second curve may extend around a second axis of curvature with a second radius of curvature, the first radius of curvature being different from the second radius of curvature. When the curve does not correspond to an arc of a circle, the radius of curvature is measured at the vertex of the curve.

In some exemplary embodiments, the first radius of curvature measured at the vertex of the first curve is smaller than the second radius of curvature measured at the vertex of the second curve, the first curve being situated closer to the distal stem portion than the second curve.

The second radius of curvature may differ from the first radius of curvature by at least 10%, or even by at least 15%, or, e.g., by at least 20%.

By way of example, the value of the first radius of curvature may lie in the range 10 millimeters (mm) to 16 mm, e.g. about 14.4 mm.

By way of example, the value of the second radius of curvature may lie in the range 20 mm to 35 mm, e.g. about 29 mm.

The distance between the vertex of a curve and the longitudinal axis of the distal stem portion may be greater than zero for at least the first curve and the second curve.

The sum of the first distance $d_1$, between the vertex of the first curve and the longitudinal axis of the distal stem portion, and the second distance $d_2$, between the vertex of the second curve and the longitudinal axis of the distal stem portion, may be less than a greatest transverse dimension of the stem, e.g. less than the diameter of the stem, or even strictly less, or, in a variant, greater, or even strictly greater.

The core may be curved in a plane that is parallel to the greatest width of the brush, or in a plane that is perpendicular to the greatest width of the brush.

The core of the brush may be fastened to the distal stem portion, for example, by being inserted into a housing of the distal stem portion, e.g., by being force-fitted in said housing.

The core of the brush may be curved around the first axis of curvature as soon as it exits said housing, or, in a variant, at a non-zero distance from the distal stem portion. The brush may comprise a rectilinear core portion that is connected to the distal stem portion, and that extends over a non-zero distance from the distal end of the stem.

The longitudinal axis of the core may define a first point of inflexion between the vertices of the first and second curves. The point of inflexion may optionally be situated on the longitudinal axis of the distal stem portion.

The longitudinal axis of the core may have an undulating shape and may define a third curve that is concave towards the first side of the core and that curves about a third axis of curvature, that may be parallel to the first and second axes of curvature, with a third radius of curvature that may be equal to or different from, in particular that may be shorter or longer than, at least one of the first and second radii of curvature.

By way of example, the value of the third radius of curvature may lie in the range 50 mm to 90 mm, e.g., about 70 mm.

The first curve may extend along the longitudinal axis of the distal stem portion over a first length that is less than a second length $l_2$ over which the second curve extends along the longitudinal axis.

The first length $l_1$ may be measured between firstly the point of intersection A of the longitudinal axis of the core with the longitudinal axis of the distal stem portion between the first and second curves, and secondly the distal end of the stem.

The second length $l_2$ may be measured between firstly the same point of intersection A, and secondly, depending on circumstances: a distal end of the brush; a point of intersection B with the longitudinal axis of the distal stem portion, said point being situated between the second curve and a third curve; or a point of inflexion between the second curve and a third curve.

The brush may comprise a distal portion that is rectilinear and that extends parallel to the longitudinal axis of the distal stem portion, or even in alignment therewith.

The longitudinal axis of the core and the longitudinal axis of the distal stem portion may intersect at one or more points, e.g., two or even three points, not comprising a location where the brush and the distal stem portion contact one another.

The brush may comprise a proximal first end that is fastened to the distal stem portion, and a distal second end that is remote from its first end.

The distal end of the core of the brush may be situated on the longitudinal axis of the distal stem portion, or it may be offset relative thereto.

The free ends of the bristles of the brush define an envelope surface of the brush that need not be circularly symmetrical about the longitudinal axis of the core, when straightened out for the purpose of observation.

The cross-section of the envelope surface of the brush may vary along the longitudinal axis of the core.

For example, it may decrease towards its free end, the envelope surface thus being of shape that is generally conical or frustoconical.

The shape of the cross-section of the brush may be selected from the following list: circular; non-circular; oblong; oval; polygonal, in particular square, rectangular, or triangular; this list not being limiting.

In variant exemplary embodiments, the brush may be as wide as it is thick, at least at one cross-section, or even over a majority of its length, or even over its entire length.

In variant exemplary embodiments, the brush may have a cross-section that is oblong.

The greatest width of the brush may be greater, by at least 3 mm, than its thickness measured at the same location on the longitudinal axis of the core as where the greatest width is measured.

The thickness of the brush may lie in the range 2 mm to 7 mm, e.g., in the range 2.5 mm to 6.5 mm, or even in the range 3 mm to 6 mm or 3.5 mm to 5.5 mm. A greatest dimension of a cross-section of the brush may lie in the range 5 mm to 13 mm, or even in the range 7 mm to 11 mm, e.g., in the range 8 mm to 10 mm.

The brush may present two opposite main faces, with the spacing between them defining the thickness of the brush. The main faces may be planar and parallel to each other when the brush is straightened. The main faces may be parallel to a plane containing the longitudinal axis of the core.

The brush may comprise a twisted core in which the bristles are held.

By way of example, the brush may comprise 9 to 100 bristles per turn, e.g., 10 to 80 bristles per turn. The number of bristles per turn corresponds to the number of bristle ends counted by a stationary observer while the brush turns through 180° about its core.

In a variant, the brush may be made by molding, e.g. as a single part, in particular by injection-molding, or by molding the bristles onto the core. Such a molded brush may also be designated by the term "comb", and the bristles by the term "teeth".

In the meaning of the present invention, the term "bristle" should be understood to mean any individual projecting element carried by the core. The terms "bristle" or "projecting element" or "tooth" are interchangeable, even if the term "bristle" is normally used to designate projecting elements fitted on a core, e.g. as for a twisted-core brush, and even if the term "tooth" is often used to designate applicator elements of a brush or a comb made by molding.

The configuration of the molded brush may be obtained by the shape of the mold used for molding, or, in a variant, the core may be deformed while unmolding, by twisting said core, in particular while the material is still hot.

The core of the applicator may be of cross-section that is polygonal, e.g. in the shape of an optionally-regular polygon, e.g. triangular, square, rectangular, pentagonal, hexagonal, heptagonal, or octagonal. The faces of the core may be plane or slightly concave or slightly convex.

The core may have 3 to 8 longitudinal faces, or even 3 to 6 longitudinal faces.

The longitudinal faces of the core may be separated by sharp edges.

The teeth may be of any shape.

The stem may comprise a distal portion that is elastically deformable. By way of example, the distal portion may be formed by an endpiece that is fitted on the remainder of the stem that may be made of a material that is more rigid. The endpiece may include one or more annular grooves, imparting more flexibility thereto.

The stem may comprise a proximal portion that is remote from the distal portion, and to which a handle of the applicator is connected.

Some embodiments may include a device, e.g., a packaging and applicator device, comprising a container containing the composition for application to the eyelashes or the eyebrows, and any applicator as described herein.

The device may comprise a wiper member for wiping the brush while it is being taken out of the container, said wiper member being disposed on a neck of the container, for example.

The handle of the applicator may serve as a closure cap for closing the container. By way of example, they may cooperate by screw-fastening. The container and the closure cap may be configured in such a manner as to close the container in leaktight manner.

Some examples may include a method of manufacturing a twisted-core brush of an applicator as described herein. In the method, the core may be curved around at least two axes of curvature with a first radius of curvature and a second radius of curvature, the two axes of curvature possibly being parallel, and the two radii of curvature possibly being different.

Some examples may include a cosmetic treatment method, e.g., a method of applying makeup to the eyelashes or the eyebrows. In the method a composition may be applied to the eyelashes or the eyebrows by using an applicator as described herein. For example, the method may include loading the applicator with a cosmetic composition, and applying the cosmetic composition to the eyelashes or eyebrows via the applicator.

Aside from the structural and procedural arrangements set forth above, the invention could include a number of other arrangements such as those explained hereinafter. It is to be understood that both the foregoing description and the following description are exemplary only.

BRIEF DESCRIPTION OF THE DRAWINGS

The accompanying drawings are incorporated in and constitute a part of this specification. The drawings illustrate exemplary embodiments and, together with the description, serve to explain some principles of the invention. In the drawings.

MORE DETAILED DESCRIPTION

Figure 1:
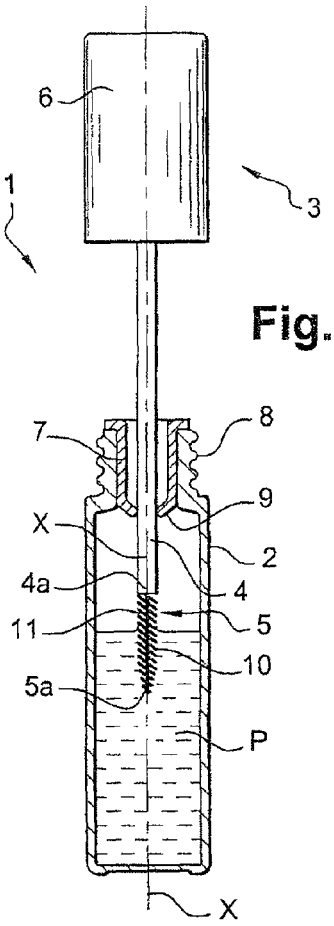
FIG. 1 is diagrammatic view in elevation, and partially in axial section, showing an embodiment of a packaging and applicator device of the invention.

Reference will now be made in detail to a few exemplary embodiments of the invention. Wherever possible, the same reference numbers are used in the drawings and the description to refer to the same or like parts.

FIG. 1 shows a packaging and applicator device 1 comprising: a receptacle 2 containing a composition P for application to the eyelashes or the eyebrows, e.g. mascara; and an applicator 3 comprising: a stem 4, e.g. of circular cross-section, that is provided at its distal stem portion 4*a* with a brush 5 and that is connected at its proximal end to a handle 6 that also constitutes a closure cap for closing the receptacle 2. The receptacle is fitted with a wiper member 7, e.g. constituted by a part made of elastomer that is inserted in the neck 8 of the receptacle. The wiper member 7 may optionally be conventional, indeed it may be adjustable.

In the embodiment under consideration, the stem 4 presents a rectilinear longitudinal axis X that coincides with the axis of the neck 8 of the receptacle 2 when the applicator is in place on said receptacle, and with the longitudinal axis of its distal stem portion 4*a*.

In the embodiment shown, the wiper member 7 includes a wiper orifice 9 of circular section, having a diameter that corresponds substantially to the diameter of the stem 4.

The handle 6 may be circularly cylindrical, as shown, or, in a variant, it may include at least one flat and/or indicator making it possible to index the brush relative to the handle.

The brush 5 includes a core 10 formed by two twisted metal strands, the core thus being other than a core made of thermoplastic material, the core 10 having a proximal portion that is fastened in a housing of the stem 4, e.g. being force-fitted in the housing. By way of example, the two strands are obtained by folding a wire in half.

Figure 45:
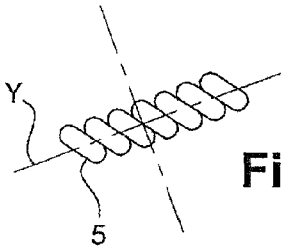
FIGS. 45 and 46 show twisted cores respectively having left-hand and right-hand twist.
Figure 46:
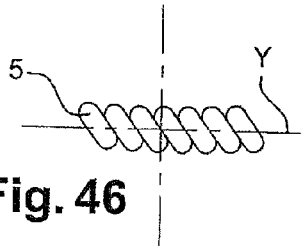

The strands of the core may be given a left-hand twist or a right-hand twist. The strands of the core may be of diameter lying in the range 0.35 mm to 1 mm, for example. The brush may have a left-hand twist. FIG. 45 shows the brush 5 with a core having a left-hand twist, and FIG. 46 shows a brush with a core having a right-hand twist. On this topic, reference can usefully be made to European patent EP 0 611 170.

The core 10 of the brush extends along a longitudinal axis Y that is curved.

Figure 3:
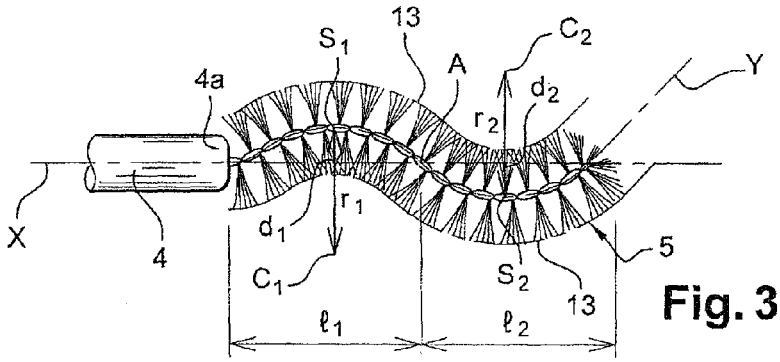
FIGS. 3 and 4 are fragmentary views showing the applicator of FIGS. 1 and 2 as seen looking along perpendicular directions III and IV respectively of FIG. 2.

The core of the brush defines at least two curves, firstly around a first axis of curvature $C_1$ with a first radius of curvature $r_1$, and secondly around a second axis of curvature $C_2$ with a second radius of curvature $r_2$, as shown in FIG. 3. The radii of curvature are measured at the vertices $S_1$ and $S_2$ respectively of the two curves.

In the embodiment described, the longitudinal axis of the core Y extends entirely within a plane, the axes of curvature $C_1$ and $C_2$ being parallel to each other. This is in contrast to what is shown, for example, in FIGS. 32 and 33 of U.S. Pat. No. 6,662,810, which corresponds to the application EP 1 236 421, in which a longitudinal axis of a core of an applicator extends in multiple planes.

Figure 4:
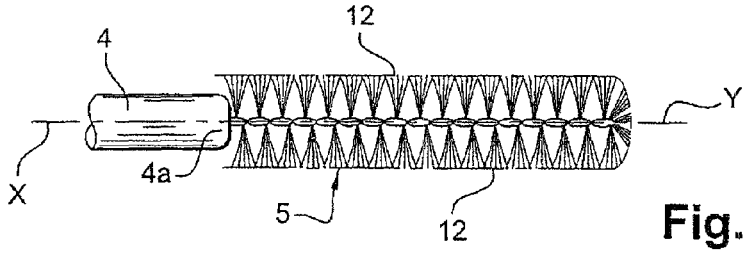

When the brush of the embodiment shown in FIGS. 1 to 5 is turned through 90° about the axis X, the longitudinal axis Y appears to be rectilinear, as shown in FIG. 4, since it extends in a single plane that is perpendicular to the plane in FIG. 1, and which is the plane in FIG. 3.

Furthermore, in the embodiment shown in FIGS. 1-5, the first radius of curvature $r_1$ is shorter than the second radius of curvature $r_2$, the first axis of curvature $C_1$ being closer to the first end 4*a* of the stem 4 than the second axis of curvature $C_2$.

The distance $d_1$ measured between the vertex $S_1$ of the first curve and the axis X is less than the distance $d_2$ measured between the vertex $S_2$ of the second curve and the axis X.

Figure 2:
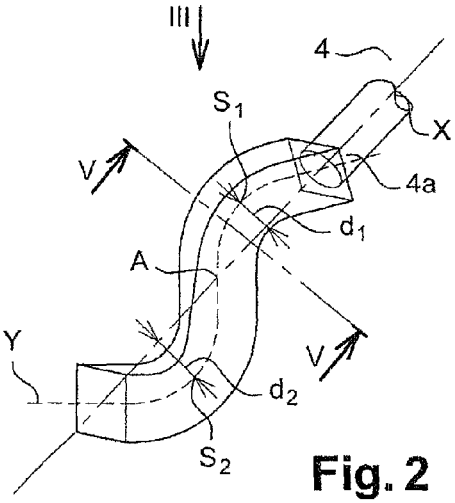
FIG. 2 is a diagrammatic and fragmentary perspective view showing the applicator of the FIG. 1 device.

The longitudinal axis Y of the core of the brush co-operates with the longitudinal axis X of the distal stem portion to define a point of intersection A, shown in FIGS. 2 and 3.

As in the embodiment in FIG. 3, it is possible to have a length $l_1$ measured between the point A and the stem that is less than the length $l_2$ measured between the point A and the distal end of the brush.

In addition, as in the embodiment described in connection with FIGS. 1-5, it is also possible for the core of the brush to curve as soon as it exits the housing of the stem 4 in which it is fastened.

Figure 6:
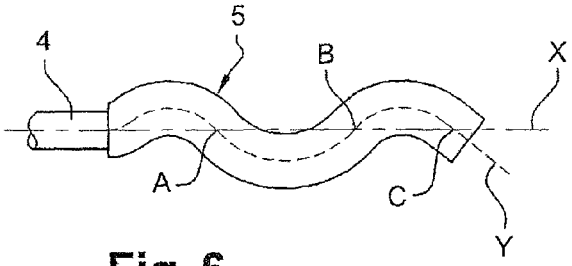
FIG. 6 is a view similar to FIG. 3 showing a variant embodiment.

FIG. 6 shows an applicator embodiment according to the invention defining three points of intersection A, B, C of the longitudinal axis Y with the longitudinal axis X, the brush including three successive curves imparting an undulating shape thereto.

The core 10 carries bristles 11 that are held by being clamped between the twisted strands of the core 10, and that extend substantially radially from the core, as can be seen in FIGS. 3 and 4.

Figure 5:
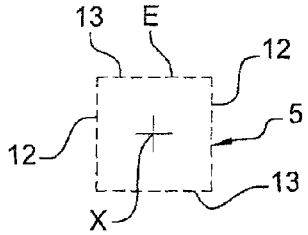
FIG. 5 is a diagrammatic and fragmentary cross-section on V-V in FIG. 2.

FIGS. 2 and 5 show the envelope surface E defined by the free ends of the bristles 11 of the brush 5. As shown in FIG. 5, the cross-section of the envelope surface E may be square.

The brush 5 may define two opposite parallel faces 12 that extend substantially parallel to the axis X, as can be seen in FIG. 4, and two opposite faces 13 that do not extend parallel to the axis X of the distal stem portion, as can be seen in FIG. 3.

In the embodiment described with respect to FIGS. 1-5, the envelope surface E is centered relative to the core 10, but it would not be beyond the ambit of the present invention if this were otherwise, with the envelope surface E of the brush 5 possibly being off-center relative to the core 10. Furthermore, the cross-section of the envelope surface E may be of a shape other than square.

The core 10 of the brush 5 may carry bristles 11 along substantially the entire visible portion of the core 10, situated outside the stem 4. In a variant, the core 10 may be free of bristles over a certain distance from the stem 4.

The envelope surface E may present a distal portion that is truncated in the shape of a pyramid or of a cone, for example, and the same could apply in the proximity of the stem 4, so as to make it easier for the brush 5 to pass through the wiper member 7.

In order to make the brush 5, it is possible, for example, to start with a brush blank of envelope surface that is a surface of revolution about the axis X of the stem, the longitudinal axis of the core of the blank being rectilinear and in alignment with the axis X.

In a first step, it is possible to machine the blank so as to obtain a cross-section that is not circular, e.g. making the faces 12 and 13 planar and parallel to each other. By way of example, it is possible to cut the brush by means of a cutter head that is rotated about an axis of rotation that is perpendicular to the longitudinal axis of the stem, in such a manner as to form the planar faces 12 and 13.

During manufacture of the brush, it is possible to machine a first side, then turn the brush so as to machine the next side. In a variant, it may be the cutter head that is moved relative to the brush, or both the cutter head and the brush that are moved.

The blank may be cut even after the core has been fastened to the stem. In a variant, the brush may be machined before being fastened to the stem.

In a second step, the core may be curved about the first and second axes of curvature $C_1$ and $C_2$ with the first and second radii of curvature $r_1$ and $r_2$ respectively, e.g. using one or more templates of different radii around which the core 10 of the brush 5 is curved either simultaneously or successively.

In order to apply makeup, the user unscrews the applicator and removes the brush 5 from the receptacle 2.

The user may use one of the faces 12 that is parallel to the axis X of the stem 4 to apply the composition P to the eyelashes or the eyebrows and/or to comb said eyelashes or eyebrows in relatively uniform manner.

The user may also turn the brush 5 about its axis X, i.e. through 90° in the embodiment described, and may use the faces 13 that are curved to apply the composition in non-uniform manner, e.g. to apply makeup to the ends of a set of eyelashes, in particular at the corners of the eye.

Figure 6A:
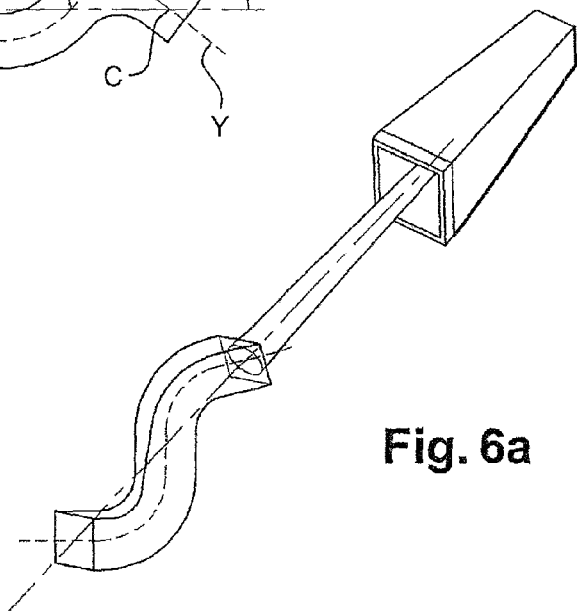
FIG. 6*a* is a view similar to FIG. 2 showing a variant embodiment.

One of the faces, e.g. a curved face 13 or a face 12, may be indexed relative to a flat and/or an indicator of the handle. By way of example, the cross-section of the handle may be square, corresponding to the cross-section of the brush, as shown in FIG. 6*a*.

Naturally, various modifications may be applied to the applicator, and in particular to the brush, without going beyond the ambit of the present invention.

In the embodiment in FIGS. 1 to 5, a brush blank is used that is initially a body of revolution.

This could be otherwise, and a blank could be used that initially presents some other shape in longitudinal section.

Figure 7:
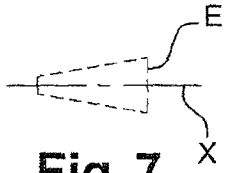
FIGS. 7 to 10 are examples amongst others, in longitudinal section, of envelope surfaces of brush blanks that may be used to make applicators in accordance with some embodiments of the invention.
Figure 8:
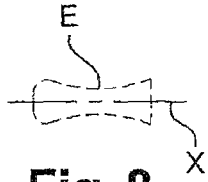
Figure 9:
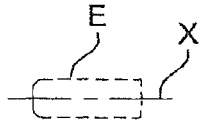
Figure 10:
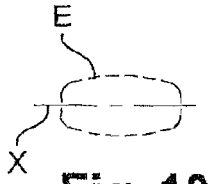

By way of example, the longitudinal section of the blank may be: triangular or trapezoidal, as shown in FIG. 7; hourglass-shaped, as shown in FIG. 8; lens-shaped, as shown in FIG. 9; or rectangular, as shown in FIG. 10.

In addition, the envelope surface E of the brush 5 may present a cross-section that is square, as shown in FIGS. 1 to 5. In a variant, at least at one point along its length, the envelope surface E of the brush may present another shape in cross-section, as shown in FIGS. 11 to 21, 16*a* to 16*c* and 21*a*.

Figure 11:
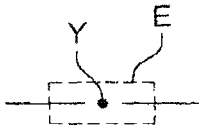
FIGS. 11 to 21, 16*a* to 16*c*, 21*a* and 21*b* show examples of cross-sections of the envelope surface, amongst others.
Figure 12:
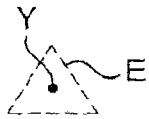
Figure 13:
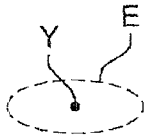
Figure 14:
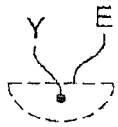

By way of example, the cross-section of the envelope surface E of the brush 5 may be: rectangular, as shown in FIG. 11; or even triangular, as shown in FIG. 12; lens-shaped, as shown in FIG. 13; or semi-elliptical, as shown in FIG. 14.

Figure 15:
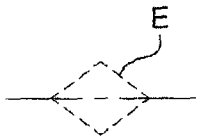
Figure 16:
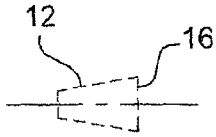

The cross-section of the envelope surface may also be: lozenge-shaped, as shown in FIG. 15; or trapezoid-shaped, as shown in FIG. 16.

Figure 16A:
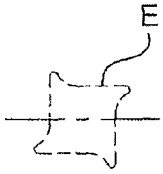
Figure 16B:
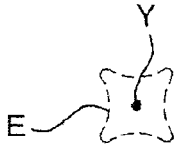
Figure 16C:
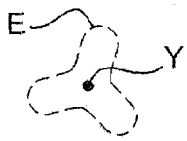

The cross-section of the brush may present: projections, as shown in FIG. 16*a*; or indentations, as shown in FIGS. 16*b* and 16*c*.

In the exemplary embodiments described above in connection with FIGS. 1-16, the face 12 is plane, but it is not beyond the ambit of the present invention for the face 12 to be defined by a generator line that is moved parallel to the longitudinal axis X along a non-rectilinear directrix.

Figure 17:
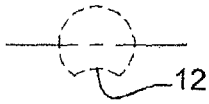
Figure 18:
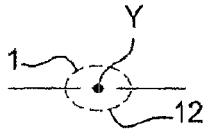

By way of example, FIG. 17 shows a brush including at least one concave face 12 having a generator line that is parallel to the axis X, and FIG. 18 shows a brush with at least one convex face 12. In FIG. 18, it can be seen that the brush may present an envelope surface of cross-section that is oblong, in particular lens-shaped, at least at one point along the core.

Figure 19:
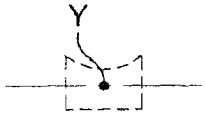
Figure 20:
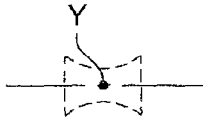

Still in a variant, a cross-section of the brush may present: a concave side, as shown in FIG. 19; or two opposite concave sides, as shown in FIG. 20.

Figure 21:
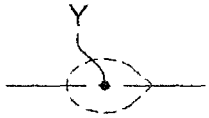

The cross-section of the brush may also be: airfoil-shaped, as shown in FIG. 21.

In general, the brush may present a cross-section that is optionally constant over the major fraction of its length, or even over its entire length. It may decrease towards its free end, as shown in FIG. 21*a*, the brush thus being of shape that is generally conical or frustoconical.

Figure 21B:
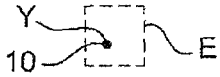
Figure 21A:
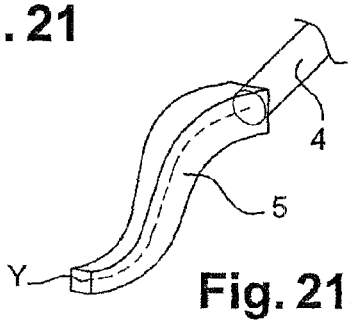

The cross-section of the brush may be off-center relative to the core of the brush in the cross section, as shown in FIG. 21*b*.

Any kind of bristles may be used in a brush made in accordance with the invention. In particular, it is possible to use a mixture of bristles that are different.

By way of example, the brushes shown are made with bristles of circular section, of diameter lying in the range 65 micrometers (μm) to 400 μm.

Figure 22:
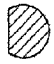
FIGS. 22 to 39 show various examples of bristle cross-sections.
Figure 23:
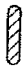
Figure 24:
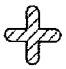
Figure 25:
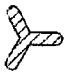
Figure 26:
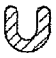
Figure 27:
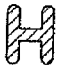
Figure 28:
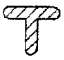
Figure 29:
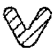
Figure 30:
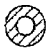
Figure 31:
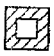
Figure 32:
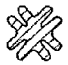
Figure 33:
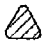
Figure 34:
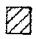
Figure 35:
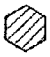
Figure 36:
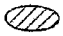
Figure 37:
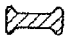
Figure 38:
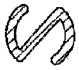
Figure 39:
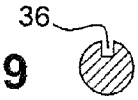

It is possible to use solid or hollow bristles of section that is circular or that presents one of the shapes shown diagrammatically in FIGS. 22 to 39, e.g. a circular shape with a flat as shown in FIG. 22; a flat shape as shown in FIG. 23; a star shape, e.g. a cross shape, as shown in FIG. 24 or having three branches as shown in FIG. 25; U-shaped as shown in FIG. 26; H-shaped as shown in FIG. 27; T-shaped as shown in FIG. 28; V-shaped as shown in FIG. 29; a hollow shape, e.g. circular as shown in FIG. 30 or square as shown in FIG. 31; forming ramifications, e.g. snowflake-shaped as shown in FIG. 32; of prismatic section, e.g. triangular as shown in FIG. 33; square as shown in FIG. 34; or hexagonal as shown in FIG. 35; or even oblong-shaped, in particular lens-shaped as shown in FIG. 36; or hourglass-shaped as shown in FIG. 37. It is possible to use bristles having portions that are hinged relative to one another, as shown in FIG. 38. It is also possible to use bristles that present at least one capillary channel 36, as shown in FIG. 39.

Figure 40:
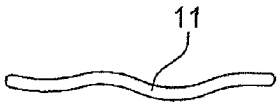
FIG. 40 shows a side view of an undulating bristle.

Before being put into place between the strands of the core, the bristles 11 that are held between the twisted strands of the core may present an optionally rectilinear shape, e.g. an undulating shape, as shown in FIG. 40.

Figure 41:
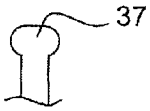
FIGS. 41 to 44 are fragmentary and diagrammatic views of examples of bristles.
Figure 42:
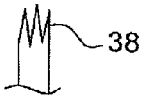

The bristles may be subjected to a treatment that seeks to form, at their ends, beads 37, as shown in FIG. 41, or spikes 38, as shown in FIG. 42.

Figure 43:
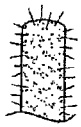
Figure 44:
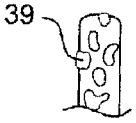

It is possible to use flocked bristles, as shown in FIG. 43, or even bristles that are made by extruding a plastics material containing a filler of particles 39, e.g. particles of a moisture-absorbing material, so as to impart a micro-relief to the surface of the bristles, as shown in FIG. 44, or so as to give them magnetic or other properties.

The brush may be magnetizable or magnetized.

The bristles may also be made with a material presenting properties that favor sliding and/or springiness.

The bristles may be natural or synthetic, and may, for example, be fabricated out of a material selected from: PE; PA, in particular PA6, PA6/6, PA6/10, or PA6/12; Hytrel®; Pebax®; silicone rubber; PU; this list not being limiting.

The bristles of the brush may be subjected to a treatment of abrasion, grinding, stamping, or hot-melting, in particular at their ends.

The bristles may cross one another.

The brush may comprise at least one portion having curved bristles extending from the core in oriented manner, e.g. as described in US application No. 2004/0168698. The term "extending in oriented manner" means that the curved bristles extend with a general orientation that is defined during manufacture of the brush, and they do not extend with completely random orientations. In particular, the bristles may be oriented in the same circumferential direction around the core. The bristles may be curved by contact with a hot surface, in particular a surface moving relative to the brush.

The brush may comprise at least two deformed bristles that are engaged between two adjacent turns for example, each bristle presenting a removal of material or a flattening at least at one point along its length from the core, and extending outwards, non-radially, from said point, as described in US application publication No. 2004/0240926. Each deformed bristle may include two rectilinear portions forming a bend between them. The two rectilinear portions may present the same cross-section. All of the deformed bristles may define bends that are all situated substantially at the same distance from the core.

Figure 47:
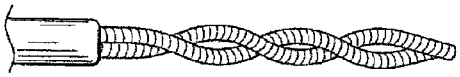
FIG. 47 is a diagram showing a double core that is formed by twisting together two individual twisted cores.

In a variant, in order to make the core, it is possible to use a double wire that is itself twisted so as to trap the bristles, thereby making it possible to make the distribution of the free ends of the bristles more random. The brush may also be formed by twisting together two twisted cores, as shown in FIG. 47, each core carrying bristles. Each of the two individual cores may be constituted by a respective branch of a single twisted core that is folded into a U-shape, with the two branches then being twisted together.

Figure 48:
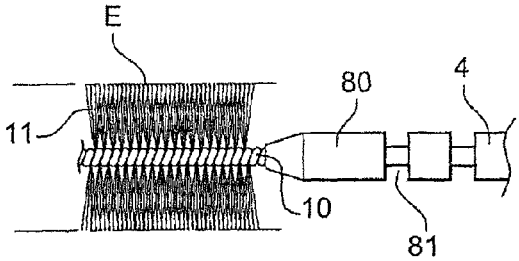
FIGS. 48 and 49 show the possibility of making the stem with a distal portion that is flexible.
Figure 49:
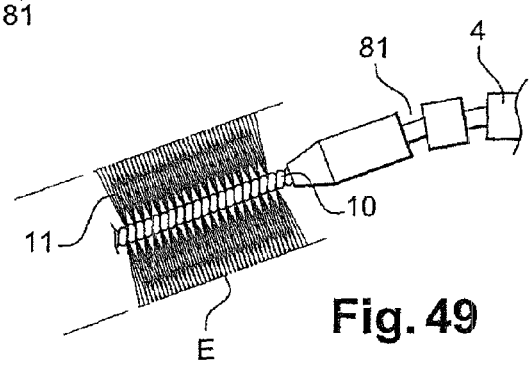

At its end, and as shown in FIG. 48, the stem 5 may be provided with an elastically-deformable endpiece 80 that serves as a support to the core of the brush and that leaves a certain amount of angular clearance while the brush is being removed from the container or during application, as shown in FIG. 49. The endpiece includes a groove 81, for example. By way of example, the endpiece is as described in EP 1 917 883 A2 and may be made, at least in part, of a material from the following list: elastomer material; thermoplastic; thermoplastic elastomer; low-density polyethylene (LDPE); polyvinyl chloride (PVC); polyurethane (PU); thermoplastic elastomer polyesters, in particular copolymers of esterified polytetramethylene oxide glycol and butene terephthalate; Hytrel®; ethylene-propylene-diene terpolymer (EPDM); propylene-diene terpolymer (PDM); ethyl vinyl acetate (EVA); styrene-isoprene-styrene (SIS); styrene-ethylene-butylene-styrene (SEBS); styrene-butadiene-styrene (SBS); latex; silicone rubber; nitrile rubber; butyl rubber; polyurethane; polyether block amide; polyester; this list not being limiting. The endpiece may be made of a material having hardness that lies in the range 25 on the Shore A scale (ShA) to 80 on the Shore D scale (ShD), for example, or even in the range 40 ShA to 70 ShD. The rigid portions of the stem may be made of a thermoplastic material, in particular one of the materials selected from the following list: high-density polyethylene (HDPE); LDPE; linear polyethylene (PE); polycrystalline (PT); polypropylene (PP); polyoxymethylene (POM); polyamide (PA); polyethylene terephthalate (PET); and polybutyl terephthalate (PBT); this list not being exhaustive.

Naturally, the invention is not limited to the embodiments described above.

The brush may be caused to vibrate either by a generator that is mounted in the applicator, e.g. on the handle, in optionally-removable manner, or by an external vibrator element that is mounted on a finger of the user, for example.

A vibration generator is described in French patent application FR 2 882 506. Vibration may make it possible to obtain better separation of the eyelashes, and, when using a composition containing fibers, to obtain better orientation of said fibers, and/or make it easier for the applicator to take up composition. While taking composition, the applicator element may be subjected to vibration from the vibration source, thereby making it possible to obtain a composition load that is more uniform on the applicator element.

When the brush is observed in cross-section, the core may be central. In a variant, the core may be off-center in the cross-section of the brush.

A wiper member having a wiper orifice that is defined by an undulating lip may be used.

The brush may comprise one or more notches that may extend as far as the core of the brush.

The expression "comprising a" should be understood as being synonymous with "comprising at least one".

What is claimed is:

1. An applicator for applying a cosmetic composition to eyelashes or eyebrows, the applicator comprising:

a stem having a distal stem portion extending along a longitudinal axis; and a brush extending from the distal stem portion, the brush comprising a core supporting bristles, the core extending along a longitudinal axis that is entirely contained within a single plane and having a first curve that is concave towards a first side of the core and having a second curve that is concave towards a second side of the core opposite from the first side of the core, the first curve being different from the second curve, a distal end of the core being aligned with the longitudinal axis of the distal stem portion;

wherein the longitudinal axis of the core crosses the longitudinal axis of the distal stem portion at least once;

wherein the core of the brush extends along the longitudinal axis of the core towards a free end of the core without turning back towards the distal stem portion;

wherein the first curve comprises a first vertex on the longitudinal axis of the core and the second curve comprises a second vertex on the longitudinal axis of the core, the first vertex being located on a first side of the longitudinal axis of the distal stem portion and the second vertex being located on a second side of the longitudinal axis of the distal stem portion opposite from the first side of the longitudinal axis of the distal stem portion;

wherein free ends of the bristles of the brush define an envelope surface that is not circularly symmetrical about the longitudinal axis of the core, when the core is straightened, and which defines at least two faces oriented perpendicularly to the single plane containing the longitudinal axis of the core;

wherein a first radius of curvature measured at the first vertex of the first curve is smaller than a second radius of curvature measured at the second vertex of the second curve and wherein the second radius of curvature differs from the first radius of curvature by at least 10%; and wherein the envelope surface is either conical or frustoconical along at least a fraction of the core, when the core is straightened.

2. An applicator according to claim 1, wherein a tangent to the longitudinal axis of the core at any point along the core forms an angle with the longitudinal axis of the distal stem portion that is less than 90 degree.

3. An applicator according to claim 1, wherein the first curve and the second curve differ with regard to at least one of shape and radius of curvature.

4. An applicator according to claim 1, wherein the first curve is located closer to the distal stem portion than the second curve.

5. An applicator according to claim 1, wherein a distance between the first vertex of the first curve and the longitudinal axis of the distal stem portion is greater than zero, and wherein a distance between the second vertex of the second curve and the longitudinal axis of the distal stem portion is greater than zero.

6. An applicator according to claim 1, wherein the first curve extends along the longitudinal axis of the distal stem portion over a first length that is less than a second length over which the second curve extends along the longitudinal axis of the distal stem portion.

7. An applicator according to claim 1, wherein the longitudinal axis of the core defines a third curve that is concave towards the first side of the core.

8. An applicator according to claim 1, wherein the longitudinal axis of the core and the longitudinal axis of the distal stem portion intersect at a plurality of points.

9. An applicator according to claim 1, wherein the longitudinal axis of the core and the longitudinal axis of the distal stem portion intersect at two points.

10. An applicator according to claim 1, wherein the brush comprises a distal brush portion that is rectilinear and that extends along the longitudinal axis of the distal stem portion.

11. An applicator according to claim 1, wherein the brush has a first main face and a second main face opposite the first main face that are planar and parallel to each other when the core is straightened.

12. A device comprising: a container containing a composition for application to the eyelashes or the eyebrows; and the applicator as defined in claim 1.

13. A device according to claim 12, wherein the container and the applicator are configured to permit the brush to be inserted into the container and removed from the container, and wherein the device further comprises a wiper member configured to wipe the brush while the brush is removed from the container.

14. A cosmetic treatment method for treating the eyelashes or the eyebrows, comprising: loading the applicator as defined in claim 1 with a cosmetic composition; and applying the cosmetic composition to the eyelashes or eyebrows via the applicator.

15. A device according to claim 11, wherein the brush further comprises a third face and a fourth face that are planar and parallel to each other when the core is straightened.

16. A device according to claim 1, each of the first curve and the second curve is spaced at a respective non-zero distance from the distal stem portion.

17. A device according to claim 1, wherein the distal stem portion is elastically deformable.

18. A device according to claim 1, wherein the first curve is defined by an arc having a substantially constant radius and the second curve is defined by an arc having a radius that varies along its length.

19. An applicator according to claim 1, wherein the second radius of curvature differs from the first radius of curvature by at least 15%.

20. An applicator according to claim 1, wherein the second radius of curvature differs from the first radius of curvature by at least 20%.

21. A device according to claim 1, wherein:

the fraction of the core along which the envelope surface is either conical or frustoconical extends less than one third of the length of the core, a largest transversal dimension of the brush remains constant along a remaining part of the core, and the envelope surface has a transversal section comprising two sides with a non-zero radius of curvature.

22. A device according to claim 1, wherein:

the fraction of the core along which the envelope surface is either conical or frustoconical extends along the whole length of the core, and the envelope surface has a square-shaped transversal section.

* * * * *